United States Patent [19]

Anderson et al.

[11] 3,936,893

[45] Feb. 10, 1976

[54] ELEVATOR MEANS FOR THE CHAIR SEAT OF A CONVERTIBLE WHEEL CHAIR AND BED

[76] Inventors: Martha A. Anderson; Robert M. Anderson, both of 443 Century Drive, Campbell, Calif. 95008

[22] Filed: July 22, 1974

[21] Appl. No.: 490,396

[52] U.S. Cl. ..... 5/81 R; 5/86; 297/19; 297/90

[51] Int. Cl.² ..... A61G 01/02

[58] Field of Search ..... 5/63–69, 81, 5/86, 19; 297/82, 83, 86, 88–90, 319, 323, 340, 416; 108/145, 147; 312/306, 312

[56] References Cited

UNITED STATES PATENTS

| | | | |
|---|---|---|---|
| 2,679,286 | 5/1954 | Luckhardt | 297/19 |
| 3,147,039 | 9/1964 | Smith et al. | 297/90 |
| 3,842,449 | 10/1974 | Geurtsen et al. | 5/63 |

*Primary Examiner*—Casmir A. Nunberg

[57] ABSTRACT

The elevation of a chair seat from normal to raised bed level by cam action between the chair seat and a wheeled frame on which the chair seat is guided for up and down movement. A camshaft journaled on the underside of the chair seat with cam wheels at each end with cam edges supported on rollers journaled on the frame and lever means on the cam shaft connected to the backrest of the chair seat for rocking the cam shaft upon adjustment of the backrest between its condition of a backrest relative to the chair seat and a condition level with the chair seat as a part of the bed pad when the chair seat is raised to bed level.

7 Claims, 8 Drawing Figures

FIG. 1.
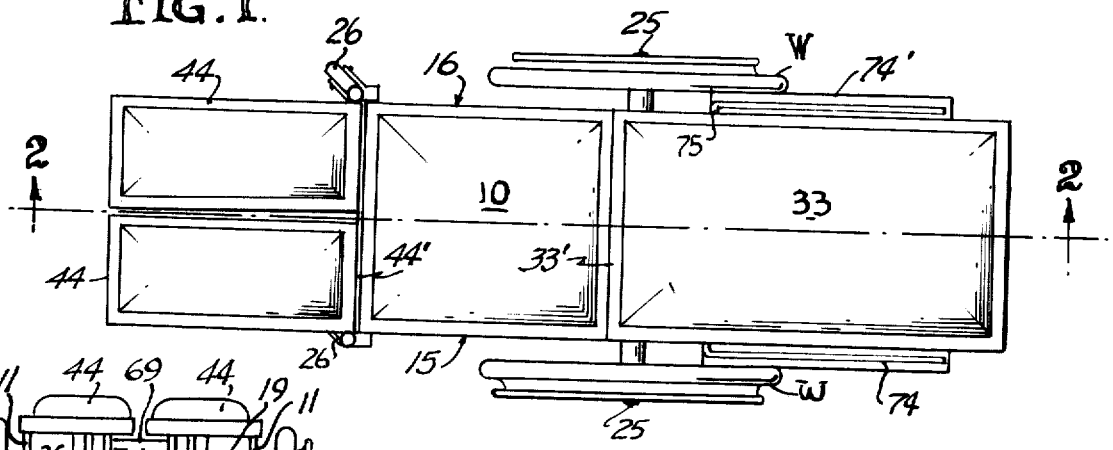
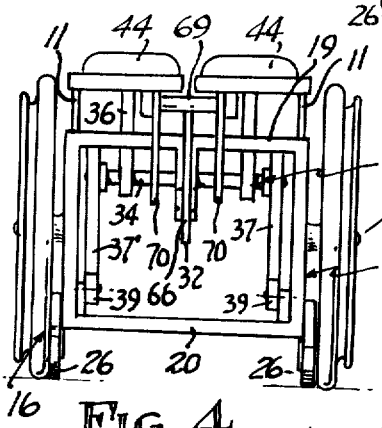
FIG. 4.
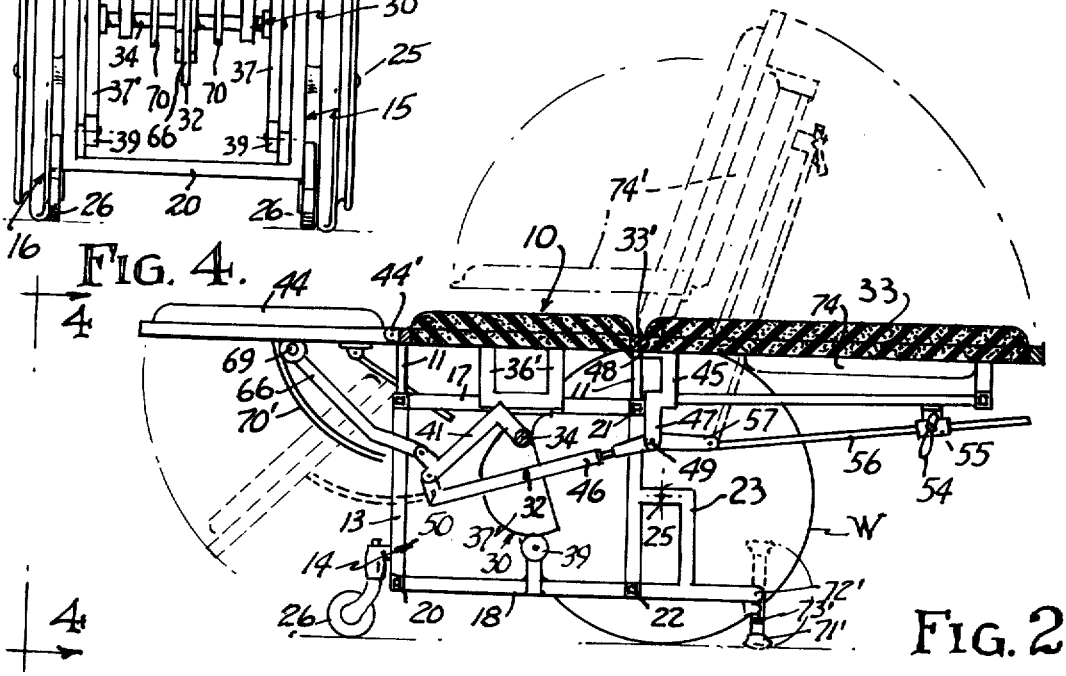
FIG. 2.
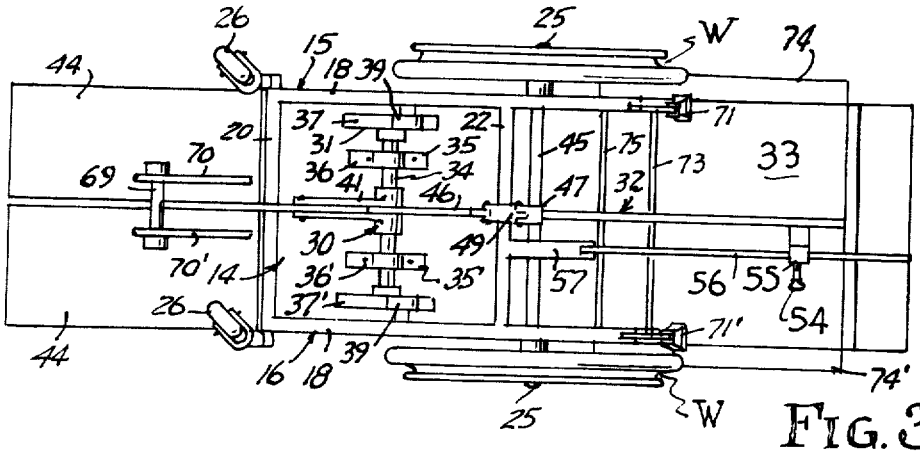
FIG. 3.

ELEVATOR MEANS FOR THE CHAIR SEAT OF A CONVERTIBLE WHEEL CHAIR AND BED

BACKGROUND

This invention relates to an invalid transferring apparatus and more particularly to a wheel chair construction facilitating convertibility of such chair into a wheeled stretcher and vice versa. In this connection it should be understood that hospital beds and the like intended for use of bed type patients are elevated to an approximate counter height to enable nurses, doctors and persons attending the needs of such patients to more easily do so without bending over or squatting to move or manipulate the patient in such bed. Wheel chairs, on the other hand, have their seats more nearly disposed at chair height wherein, the patients legs are so disposed, that their feet are but a short distance from the floor. It will therefore be appreciated that the wheeled stretcher contemplated by the instant application is of the type to support a patient at substantial bed level, i.e., at a considerable higher elevation than that of the seat of the wheel chair when the apparatus is converted into such form.

It will therefore be appreciated that the conversion of the wheel chair to a bed type stretcher, and vice versa entails an elevator mechanism operatively associated with the seat and bed for changing the elevation, thereof, in the course of convertibility.

Several prior patients disclose structure for elevating the seat per se of such type of chair so that the back and foot rests follow the independent adjustment into a horizontal support. In this art it is customary to have the foot or leg rests as well as the back of the chair hingedly connected to the chair seat and adapted to level off with the latter when it is elevated to its uppermost position as a part of the bed with the leg rests and chair back.

Other patents in the prior art coordinate the pivotal or hinged connections between the seat, back and leg rests with the frame of the vehicle type chair to utilize the parallelogram leverage afforded thereby to raise and/or lower the seat relative to the frame. This puts an excessive load upon the leverages in the course of elevating the seat with patient thereon. Likewise, the lowering of a patient on the bed-like surface to a sitting position can become quite abrupt and fraught with shock, and unnecessary shaking up of the patient during the conversion.

The present invention seeks to alleviate the foregoing problems and yet attain a smooth operating elevator mechanism controlled by the chair back, i.e., using the latter as an operating lever for the elevator while changing the chair to a bed or the bed to a chair.

THE PRESENT INVENTION

The present invention has a principal object the provision of a cam type elevator mechanism between the chair seat and frame of the apparatus. This object contemplates the interconnection of the cam mechanism with the lever action afforded by the chair back and its hinged connection to the chair seat.

It is another object of the invention to provide a cam shaft on the lower surface of the chair seat and cams on the cam shaft bearing on roller supports provided on the frame of the apparatus.

These and other objects and advantages of the present invention will become apparent in the following detailed description when read in the light of the accompanying three sheets of drawing in which:

FIG. 1 is a plan view of the convertible bed and chair made up as a bed and embodying the present invention;

FIG. 2 is a longitudinal section through FIG. 1 taken along line 2—2 therein;

FIG. 3 is a bottom plan view of the bed arrangement of FIGS. 1 and 2;

FIG. 4 is an end view of the same as seen from the left-hand end of FIG. 2;

GENERAL DESCRIPTION

Figure 8:
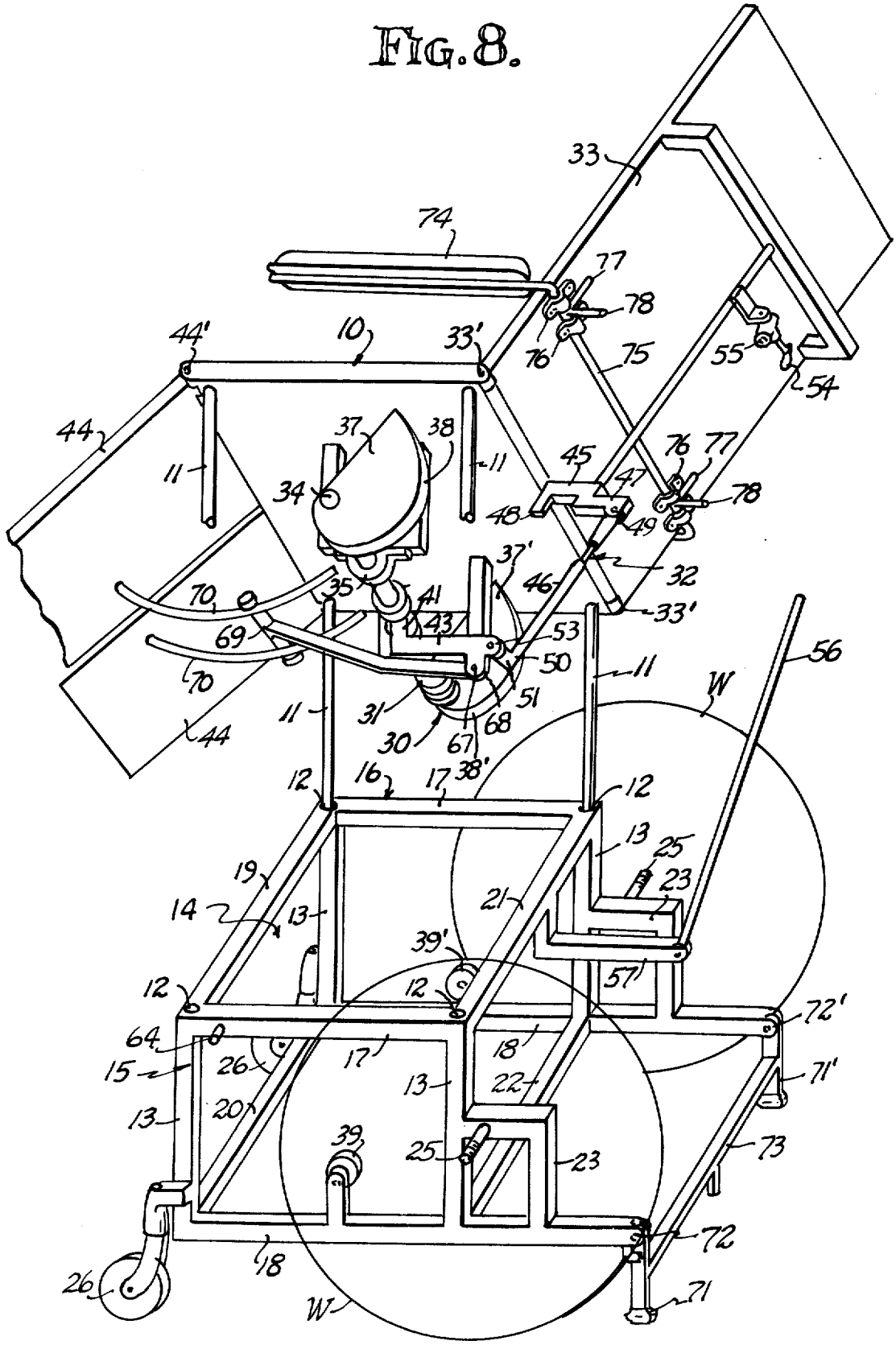
FIG. 8 is an exploded isometric view of the chair of FIGS. 5 and 6, looking down on the frame and upwardly toward the underside of the seat, leg rest and back rest of the same.

The chair and bed combination in which the present invention has its embodiment generally includes a seat 10 provided with leg-like rods, 11, extending downwardly from its bottom at each of its four corners as best seen in FIG. 8. These leg-like rods, 11, are disposed to extend downwardly into guideways 12 formed in the four corner posts 13 of a frame 14.

The frame 14, comprises a rectangular or cube type structure having a pair of sides 15–16 of identical construction to include fore and aft corner posts 13 for each side of the frame 14. Each side of the frame 14 has upper and lower tubular members 17 and 18 uniting the fore and aft corner posts 13 thereof. The sides 15 and 16 are united by upper and lower cross members 19 and 20 at their fore ends and upper and lower cross members 21 and 22, at the after end of the cube type structured frame 14. At the after end of the frame 14 the lower cross members 18, extend rearwardly and have a brace 23 formed between the latter and the aft corner posts 13. These brace members 23 provide suitable mounts for laterally extending axles 25 for the typical wheel chair wheels W having the usual hand engageable rims spaced from the spoke fellies of the wheel W.

At the fore end of each side 15 and 16 of the frame 14 a bushing and mount for a caster wheel 26 is mounted on the respective corner post 13. The frame 14 is thus supported on wheels for movement about in the usual manner.

As previously stated the four leg-like rods 11 are disposed to fit into the guideways 12 provided by the four corner posts of the frame 14. The seat 10 is thereby guided for up and down movement relative to the frame 14. The means for moving the seat between its extreme up and/or down positions constitutes an elevator mechanism 30 forming the embodiment of the present invention.

DETAILED DESCRIPTION OF THE INVENTION

In accordance with the present invention the elevator mechanism 30 comprises a cam arrangement 31 between the seat 10 and the frame 14 and means 32 for turning the cam arrangement in unison with the adjustment of the seat back 33 between its back rest position relative to the seat and a horizontal position in alignment with the seat.

More specifically, the cam arrangement 31 comprises a cam shaft 34 journalled on a pair of bearings 35–35' supported on brackets 36–36' suspended from the lower surface of the seat 10. The brackets 36–36' are spaced slightly inward from the sides of the seat 10 to provide a space for a cam 37–37' secured to the respective outer end of the cam shaft 34.

Figure 7:
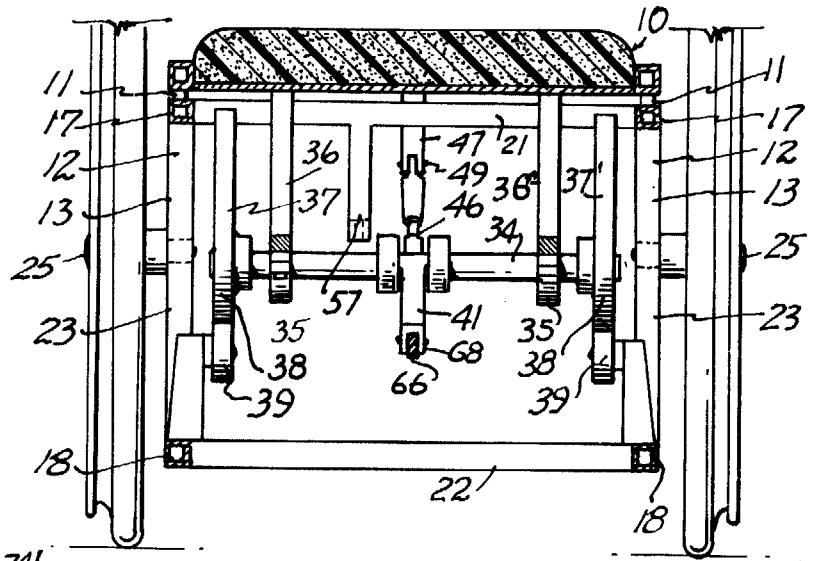
FIG. 7 is a cross section through the chair of FIG. 5, as seen from line 7—7 therein.

The cam 37 and 37' at each end of the shaft has a cam edge 38 which rides upon a roller 39–39' on a spindle shaft extending inwardly from a bracket 40–40' extending upwardly from the lowermost cross member 18 of each side 15 and 16 of the frame 14. (See FIGS. 5 and 7).

Midway between the ends of the cam shaft 34 there is a lever 41 secured to the shaft. This lever 41 facilitates rocking movement to the shaft 34 to change the position of the cams 37–37' relative to the supporting rollers 39–39'. The arrangement is such that the lever 41 is so shaped as to enable a thrust applied thereto to swing the lever 41 between its two limits about the axis of the cam shaft 34. For this reason the lever 41 has a general L shape in which the foot part 42 of the L shape extends radially from the toe end thereof which is located at the axis of the cam shaft 34.

Figure 5:
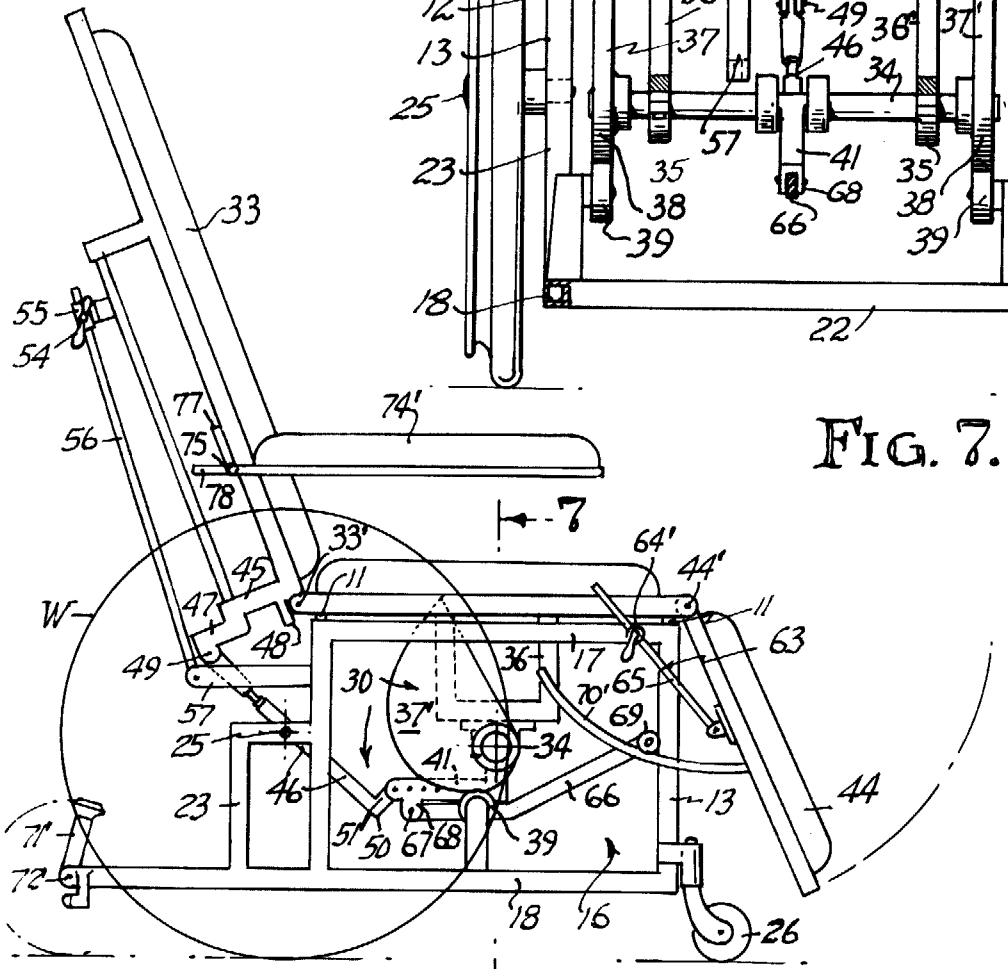
FIG. 5 is a side elevational view of the device of FIGS. 1 through 4, converted into a chair and at slightly larger scale.

Referring now to FIG. 5 it will be noted that when the seat 10 is down, i.e., lowermost as a result of the disposition of the elevator mechanism 30, the leg part 43 of the L-shaped lever 41 is substantially horizontally disposed. In such condition the cams 37–37' have their declivities nearest the axis of shaft 34 resting upon the support rollers 39 and 39' respectively. However, when the lever 41 is swung counter clockwise FIG. 5 about the axis of the cam shaft 34, the aclivity of the cam edge 38 farthest removed radially from the axis of the cam shaft 34 is at rest upon the support rollers 39–39' as shown in FIG. 2. By rotation of the cams 37–37' from the position shown in FIG. 5 to that of FIG. 2 the seat 10 is caused to be lifted, i.e., elevated to its uppermost condition for the basis of a bed.

To complete the bed, as illustrated in FIGS. 1 through 4 inclusive, the backrest 33 of the seat 10 as well as the leg rests 44 therefor must assume horizontal alignment with the seat 10. It is in this regard that the backrest 33 of the chair is operatively associated with the cam operating lever 41 of the elevator mechanism 30.

As in all forms of convertible wheel chairs the backrest 33 as well as the leg rests 44 are pivotally connected to the seat proper thereof. As best seen in the drawings the pivotal connections are designated 33' and 44' respectively at the back and front edges of the seat 10. In accordance with present invention the backrest 33 of the chair and its pivotal connection 33' to the seat of the chair 10 provides the basis for a lever 45 to operate the L shaped lever 41 on the cam shaft 34. This is accomplished by a linkage 46 between the L shaped lever 41 and the lever 45 on the backrest 33.

Referring to FIGS. 2 and 5 it will be noted that the lever 45 is connected to the backrest 33 adjacent the pivotal connection 33' thereof with the seat 10. The lever 45 extends perpendicular to the backrest 33 so as to dispose its terminal end 47 slightly below the axis of the camshaft 34 when the seat 10 is in raised position and the backrest level with the seat (FIG. 2). In this position it will be noted that a stop projection 48 on the back face of the backrest 33 extends under the bottom face of the seat 10 to maintain the backrest level with the seat. Moreover, the lever 45 has an offset portion devised to engage the back face of the uppermost cross member 21 of the frame 14 to further brace the backrest for horizontal extension rearwardly from the seat 10.

Now when the apparatus is converted into a chair, the backrest 33 is swung counterclockwise (FIG. 2) from horizontal toward raised position. In this manner the downwardly projecting lever 45 moves concurrently with the backrest to thereby pull the linkage 46 between the lever 45 and the L shaped lever 41, connected thereto in a counterclockwise direction about the axis of the cam shaft 34. This turns the cams 37–37' similarly about the axis of the cam shaft 34 to lower the seat 10 to a position as shown in FIG. 5. The length of the linkage 46 is adjustable between its upper end which is pivotally connected as at 49 to the terminal end 47 of the lever 45, and its lower end 50. The lower end 50 of the linkage 46 has an upturned foot portion 51 pivotally connected as at 52 to the extreme end 53 of the leg portion 43 of the L shaped lever 41. By this upturned offset 51 on the linkage 46 a firm thrust is applied to the lever 41 from the seat back upon manual movement of the latter.

When the seat 10 is in lowered position as a chair seat (FIG. 5) the backrest 33 can be locked in place by a thumb nut 54 on a screw shown entering a sleeve bearing 55 through which a slide bar 56 extends. The lower end of the slide bar 56 is pivotally connected to a bracket 57 which extends rearwardly from the uppermost cross member 21 of the frame 14. By this arrangement the seat and backrest are secured in position relative to the frame as a chair.

A pair of leg rests 44—44 are pivotally mounted as at 41' to the fore edge of the chair seat 10. These leg rests 44—44 are adapted to be secured at desired positions angularly to the chair seat 10 by adjustable braces 63–63' on each side 15 and 16 of the frame 14. A slide sleeve 64–64' extends from the top rail 17 of each side member 15 and 16 and adjacent the fore leg 13 thereof. Each brace 63–63' includes a slide rod 65–65' having one end secured to a leg rest 44 and an opposite end extending through the slide sleeve 64 or 64' as the case may be. A wing bolt threaded into the slide sleeve 64–64' secures the slide rod 65–65' in the desired position to support the leg rest in its lowermost position.

To maintain the leg rests in raised condition i.e. in horizontal alignment with the chair seat 10 in its raised position, the wing bolts on each slide sleeve 64 and 64' must first be released to allow the leg rest 44 to swing upwardly. The leg rests are raised automatically by means of a push rod 66 having one end pivotally connected as at 67 to an ear 68 on the L shaped lever 41. The ear 68 extends from the leg 43 of the L shaped lever 41 in a direction opposite to the direction in which the foot portion 42 extends therefrom. The ear 68 is therefore disposed lowermost when the apparatus is made up as a chair (FIG. 5). It should here be noted that the push rod 66 would normally fall toward suspension from its pivotal connection at 67 with the depending ear 68. However, to maintain the push rod 66 in an operative, raised condition, its free end has a T head 69 (FIGS. 3 and 4) which rides upon arcuate support bars 70 and 70' which extend rearwardly and upwardly from the back face of each of the leg rests 44— 44. As best seen in FIG. 5 the push rod 66 is thus held in an operative fashion ready to exert a forward thrust against the back face of each leg rest 44 and 44.

When the chair back 33 is swung downwardly to swing the L shaped lever 41 counterclockwise about the axis of the cam shaft 34. The movement thus made to the L shaped lever 41 causes the ear 68 on lever 41 to extend forwardly within the frame 14. When the seat 10 is thus completely elevated as illustrated in FIG. 2 the T head 69 of the push rod 66 presses into the acute angle of each of the support bars and the back face of the leg rests to brace and support them in horizontal position in alignment with the seat 10. The wing bolts on the slide sleeves 64–64' can thus be secured to brace the forwardly extending leg rest 44—44 horizontally with the bed level.

Referring to FIGS. 2, 5 and 8, it will be noted that the after end of the lower tubular member 18 on each side 15 and 16 of the frame 14 is provided with a stabilizing foot 71 and 71', respectively. Each foot 71 and 71' has its upper end pivotally connected as at 72–72' to the extreme end of the respective tubular bottom 18 of a side wall 15–16 of the frame 14. The opposite end of each foot has a rubber pad for engaging the floor, pavement or the like to maintain the member 18 level and prevent movement of the wheeled chair or bed.

For convenience the two foot members 71 and 71' are united by a cross bar 73 so as to move in unison between active and inactive position as a stabilizer.

Figure 6:
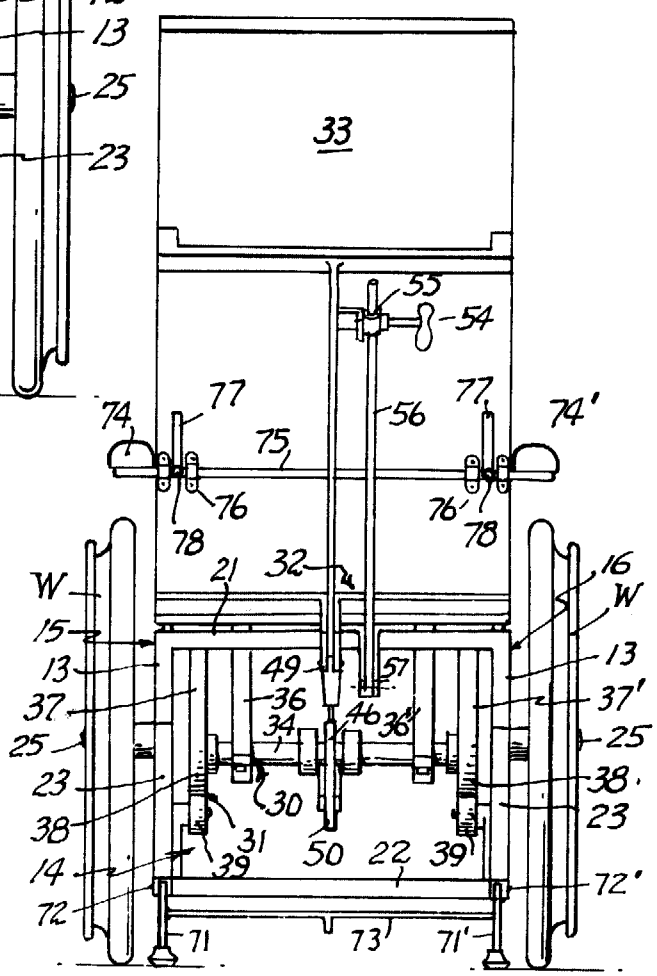
FIG. 6 is a back elevational view of the same as seen from the lefthand side of FIG. 5.

Referring to FIGS. 5 and 6 it will be noted that a pair of arm rests 74–74' are provided for the wheel chair. These arm rests 74 and 74' are pivotally mounted on the back rest 33 in such a manner as to be swung back into parallel relation with the backrest during its horizontal disposition as part of the bed (FIGS. 1 through 3.). For this reason each arm rest 74–74' is secured to a cross rod 75 which extends across the back face of the backrest 33 and is connected thereto by U straps 76. The U straps 76 are arranged as a pair adjacent each side of the backrest 33 and has a pair of radially extending stops 77–78 secured to the cross rod 75 between each said set of U straps 76. The stops 77 on each side engage the backrest 33 to maintain the arm rests 74–74' parallel to the seat and at an angle relative to the backrest when the latter serve as a chair. However, when the backrest 33 is folded back into horizontal position as part of a bed, the stops 78 on the cross rod 75 serve to hold the arm rests parallel to the backrest as in FIGS. 1, 2 and 3.

Having thus described our new convertible wheel chair and bed structure in specific detail, it will be appreciated by those skilled in the art that the same may be susceptible to modification, alteration and/or variations without departing from the spirit or scope of our claims set forth as follows:

We claim:

1. An invalid transferring apparatus comprising in combination:

a. a wheeled frame having sides with fore and aft corner posts providing tubular guideways;

b. a chair seat having leg-like rods at each of its four corners disposed in a respective corner post of said frame for guided up and down movement relative to the latter;

c. a cam shaft journaled transversally of said frame on the underside and in spaced relation to said chair seat;

d. support rollers mounted on said frame and adjacent each side wall thereof;

e. a cam wheel secured to each end of said camshaft and having their cam edges supported on said support rollers; and f. lever means on said cam shaft for turning the latter to thereby change the position of said cam wheels, relative to said support rollers and effect a raising and lowering of said chair seat relative to said frame.

2. The invalid transferring apparatus in accordance with claim 1 including a backrest for said chair seat; and a. means for pivotally connecting the lower edge of said backrest to the back edge of said chair seat;

b. an arm perpendicular to the back face of said backrest and extending therefrom adjacent said pivotal connection between the latter and said chair seat; and c. a linkage between the end of said lever means on said camshaft and the extreme end of the arm on said back rest to effect turning of said camshaft by the pivotal movement of said backrest between horizontal condition level with said chair seat and vertical condition as a backrest for said chair seat.

3. The invalid transferring apparatus in accordance with claim 2 including locking means between said frame and said back rest for securing the latter in vertical condition relative to said chair seat.

4. The invalid transferring apparatus in accordance with claim 3 in which said locking means comprises:

a. a sleeve bearing mounted on the back face of said back rest remote from said chair seat;

b. a slide bar having one end pivotally mounted on said frame and its opposite end extending through said sleeve bearing; and c. a thumb nut bolt in said sleeve bearing for securing said slide bar therein.

5. The invalid transferring apparatus in accordance with claim 2 including a pair of foot rests pivotally connected to the fore edge of said chair seat, and means between said frame and each of said footrests for releasably securing the latter in desired condition relative to said chair seat.

6. The invalid transferring apparatus in accordance with claim 5 including means for moving said footrests into level condition relative to said chair seat simultaneously with the movement of said back rest into level condition relative to said chair seat.

7. The invalid transferring apparatus in accordance with claim 6 in which said means for simultaneously moving said foot rests with said back rest comprises:

a. a push rod having one end pivotally connected to the free end of the lever means on said cam shaft;

b. a T head at the opposite end of said push rod; and c. means on the underside of each of said foot rests engageable by the T head on said pushrod for maintaining the latter in a forwardly suspended condition relative to said lever means and for guiding said T head into pushing relation relative to the underside of said footrests for swinging the latter into horizontal condition level with said chair seat upon raising of the latter relative to said frame.

* * * * *